US010962276B2

(12) United States Patent
Lindel et al.

(10) Patent No.: US 10,962,276 B2
(45) Date of Patent: Mar. 30, 2021

(54) HOUSEHOLD APPLIANCE CABINET GROUND CONNECTION

(71) Applicant: BSH HAUSGERAETE GMBH, Munich (DE)

(72) Inventors: Andreas Lindel, Heidenheim (DE); Michael Krapp, Nattheim (DE); Yun Dai, Giengen an der Brenz (DE)

(73) Assignee: BSH Hausgeraéte GmbH, Munich (DE)

( * ) Notice: Subject to any disclaimer, the term of this patent is extended or adjusted under 35 U.S.C. 154(b) by 272 days.

(21) Appl. No.: 15/827,757

(22) Filed: Nov. 30, 2017

(65) Prior Publication Data

US 2018/0156528 A1 Jun. 7, 2018

(30) Foreign Application Priority Data

Dec. 2, 2016 (DE) ..... 102016224019.6

(51) Int. Cl.

| | |
|---|---|
| ***F25D 23/00*** | (2006.01) |
| ***H01R 4/64*** | (2006.01) |
| ***H01R 4/34*** | (2006.01) |
| ***F25D 29/00*** | (2006.01) |

(Continued)

(52) U.S. Cl.

CPC ..... *F25D 23/006* (2013.01); *F25D 23/02* (2013.01); *F25D 29/005* (2013.01); *H01R 4/64* (2013.01); *F25D 23/061* (2013.01); *F25D 2400/40* (2013.01); *H01R 4/34* (2013.01)

(58) Field of Classification Search

CPC .... H01R 4/64; H01R 4/26; H01R 4/30; F16B 37/04; F16B 37/044; F16B 2200/40; F16B 2200/403; F16B 2200/406; F16B 39/382; F25D 29/00; F25D 29/005; F25D 23/061; F25D 23/065; F25D 27/00; F25D 27/005; F25D 2303/08221; F25D 2323/06; F25D 2400/40

See application file for complete search history.

(56) References Cited

U.S. PATENT DOCUMENTS 3,486,158 A * 12/1969 Soltysik ..... H01R 4/50 439/92

4,557,537 A 12/1985 Greer (Continued)

FOREIGN PATENT DOCUMENTS

CN 1292159 A 4/2001
CN 101540448 A 9/2009

(Continued)

*Primary Examiner* — Vanessa Girardi

(74) *Attorney, Agent, or Firm* — Laurence A. Greenberg; Werner H. Stemer; Ralph E. Locher

(57) ABSTRACT

A household refrigeration appliance has a housing and at least one electronics module in the housing. The electronics module is covered at least in sections by a metallic cover plate and the cover plate is in electrical contact with a further metal component, in particular with a metal sheet, of the household refrigeration appliance. The cover plate is thereby connected by way of the metal component to an electrical ground connection. The ground connection has a metallic grounding claw, separate from the cover plate and from the metal component, by way of which the cover plate and the metal component are connected to at least one connection element.

20 Claims, 5 Drawing Sheets

(51) Int. Cl.
*F25D 23/02* (2006.01)
*F25D 23/06* (2006.01)

(56) References Cited

U.S. PATENT DOCUMENTS

| | | | | |
|---|---|---|---|---|
| 5,207,588 | A * | 5/1993 | Ladouceur | B23P 19/062 29/432.2 |
| 7,641,506 | B2 | 1/2010 | Sacher et al. | |
| 9,093,778 | B2 | 7/2015 | Pillet | |
| 9,106,011 | B2 * | 8/2015 | Bengtsson | H01R 4/30 |

FOREIGN PATENT DOCUMENTS

| | | | |
|---|---|---|---|
| CN | 202032829 | U | 11/2011 |
| CN | 202797399 | U | 3/2013 |
| CN | 103119788 | A | 5/2013 |

* cited by examiner

HOUSEHOLD APPLIANCE CABINET GROUND CONNECTION

CROSS-REFERENCE TO RELATED APPLICATION

This application claims the benefit, under 35 U.S.C. § 119, of German patent application DE 10 2016 224 019.6, filed Dec. 2, 2016; the prior application is herewith incorporated by reference in its entirety.

BACKGROUND OF THE INVENTION

Field of the Invention

The invention relates to a household refrigeration appliance having a housing and at least one electronics module which is arranged in the housing. The electronics module is covered, at least in sections, by a metallic cover plate, in particular toward the outside and the cover plate is in electrical contact with a further metal component, in particular with a metal sheet, of the household refrigeration appliance, with the result that the cover plate is connected by way of the metal component to an electrical ground connection.

In the case of household refrigeration appliances it is known that various electronics modules are installed in the housing, by means of which specific functional units of the household refrigeration appliance are operated, or in which household refrigeration appliances the electronics modules are independent functional units. The electronics modules can thus be designed for the operation of operating devices, dispenser units for the output of liquid and/or ice mold elements (ice cubes), components of refrigeration circuits, illumination devices or the like, or are part of the components.

A household refrigeration appliance is disclosed in U.S. Pat. No. 4,557,537 B, entitled Electrical Grounding Arrangement and Method, in which an electrical resistance heater is arranged behind a front panel of a door limit stop, against which a door of the household refrigeration appliance abuts at the front side in the closed state. The resistance heater is arranged behind a metallic front panel. The front panel completely covers the cover panel which is arranged behind it and which is likewise constructed from metal. Both these metallic components are grounded and an electrical ground connection is thus also implemented here. For contact purposes, provision is made here that a screw is screwed in, by means of which the two metallic components are screwed to one another. For electrical contact purposes a bendable pin projecting into the hole geometry of the front panel is integrally implemented on the front panel, which bendable pin is bent backward by the screw being passed through and screwed in and thereby makes contact with the metallic cover panel situated behind.

With regard to such a design, this relatively thin and delicately bendable pin can break off and a desired contact with the metallic cover plate situated behind cannot thus exist. No ground connection would therefore be implemented, which would result in safety-critical operation. Furthermore, this very thin and delicately integrated bendable pin is difficult to manufacture, with the result that the level of production complexity is also high here. Furthermore, it is necessary when screwing in the screw to first press it such that this pin is also already bent at the same time in order to enable the screw to actually be connected mechanically to the thread situated behind in the first place and to actually enable the screws to be screwed in at all. This may also lead to the screw becoming cross-threaded as it enters the threaded channel, thus resulting in the fact that the screw cannot be screwed in completely or that screwing in causes damage. This would also mean that the desired ground connection could not be implemented sufficiently reliably.

SUMMARY OF THE INVENTION

It is accordingly an object of the invention to provide a refrigeration appliance with a specific ground connection which overcomes the above-mentioned and other disadvantages of the heretofore-known devices and methods of this general type and which provides for such a household refrigeration appliance in which the ground connection between metallic cover elements is improved.

With the foregoing and other objects in view there is provided, in accordance with the invention, a household refrigeration appliance, comprising:

a housing and an electronics module arranged in the housing; a metallic cover plate covering the electronics module at least in sections thereof;

a further metal component (e.g., a metal sheet) of the household refrigeration appliance;

a metallic grounding claw separate from the cover plate and from the further metal component;

the metallic grounding claw connecting the cover plate and the further metal component to one another and forming an electrical ground connection connecting the cover plate to electrical ground via the further metal component and at least one connection element.

In other words, the household refrigeration appliance according to the invention comprises at least one housing in which is arranged an electronics module of the household refrigeration appliance. The electronics module is covered, in particular toward the appliance exterior, at least in sections, preferably completely, by a separate metallic cover plate. The household refrigeration appliance furthermore comprises a metal component separate from the cover plate, in particular a metal sheet. The cover plate and the metal component are in electrical contact with one another, which means that the cover plate is grounded by way of the metal component or is connected to an electrical ground connection. The cover plate is thus connected to ground potential by way of the metal component. The ground connection comprises a metallic grounding claw, separate from the cover plate and from the metal component, which thus likewise constitutes an object component. The cover plate and the metal component are connected to the grounding claw by means of at least one connection element. This also means that an electrically grounding connection is created thereby. It also means that a gripping mechanical connection is implemented between the grounding claw and the cover plate and/or the metal component. An improved electrical ground connection is also implemented by means of such a design because the connection can thereby be made more reliable in respect of the grounding and furthermore an important component of the ground connection is mechanically more stable. Furthermore, the assembly is simplified by means of such a design having a separate grounding claw because said separate grounding claw is also handled individually and assembled at specific points in time during manufacture and can then also be connected to the other components. By virtue of the design as a grounding claw, in the installed state the ground connection is also arranged in positionally secure fashion because it is arranged in such a manner with other components that a certain gripping or pressing in also results and enhanced secure positioning is thereby afforded.

Provision can be made that the metal component is a part of a housing of the household refrigeration appliance. The metal component can for example be a frame element and/or a stiffening element and/or a mounting support for the electronics module. The metal component can be thin walled. In particular, the metal component can be a metal plate or a metal sheet. Provision can be made that the metal component forms, at least in sections or essentially completely, a rear wall, in particular exposed to the rear, of the housing of the household refrigeration appliance. Since said rear wall, if it includes metal, is typically grounded, the cover plate can already be grounded by means of electrically conducting contact with said rear wall.

Provision can be made that the grounding claw is arranged on a housing of the electronics module. In particular, provision can be made that the grounding claw is arranged in a receiving pocket in the housing of the electronics module. By this means it is on the one hand arranged in protected fashion, thereby creating a compact design of the entire arrangement. Furthermore, as a result of said positioning in the receiving pocket it can also already be inserted accurately and the precise final position can thereby be reliably achieved. Finally, the connection with the cover plate and the metal component can then also be achieved more simply, more quickly and more reliably in respect of assembly.

Provision is preferably made that the grounding claw is screwed to the cover plate and the metal component using a screw as the connection element. This is a mechanically very stable means of connection and moreover enables a rapid assembly process.

Provision can be made that the screw has a serrated flange. By this means the precise final position is favored once again and the mechanically secure connection of the components to be connected is achieved particularly advantageously. This is then also made possible especially on a permanent basis. The screw can be a metric screw.

Provision can be made that the grounding claw has a guide boss for guiding the connection element at least in sections. The guide boss can be formed by a cylindrical sleeve. The guide boss can in particular be a threaded boss for screwing a screw into. The threaded boss can have an internal thread. The guide boss can be implemented integrally with the grounding claw. By this means, the connection, for example a screw connection, can also be carried out with correspondingly greater forces, for example screw forces, which means that the mechanically stable connection of the components is achieved particularly advantageously. On the other hand, as a result of this integration of the guide boss into the grounding claw said guide boss is also integrated in a component which is stable as such, which means that accurately positioned seating of the guide boss is then also achieved here and assembly forces can be better absorbed.

Provision can be made that the grounding claw comprises a base plate on which a plurality of tags are integrally implemented, where said tags are oriented projecting from the plane of the base plate. By virtue of this design, on the one hand a very low profile basic component of the grounding claw, namely the base plate, is made available on which additional function elements are implemented in integrated fashion. Firstly in particular this is the plurality of tags which thus then also exhibit their gripping effect particularly advantageously as a result of said projecting orientation. Furthermore, as a result of this design the positioning of the tags is also very stable which means that unwanted bending is avoided.

Provision can be made that at least one tag is implemented on an edge section of the base plate. In comparison with a tag implemented within the base plate, which therefore is not implemented on an edge section, a simple production process can be enabled, for example by bending over corresponding lugs which project integrally from the base plate. Also conceivable in principle is a combination of tags which are implemented on an edge section of the base plate and tags which are implemented within the base plate. Provision can however also be made that tags are implemented on an edge section of the base plate.

Provision can be made that the base plate is implemented in angular form and at least one tag is implemented on each side length of the angular shape. By this means, multiple and uniform gripping is also enabled, which means that the base plate is also not bent in an unwanted fashion or arranged in an unwanted tilted position when the assembled final state of the grounding claw with the cover plate and the metal component has been reached.

This then also means that the ground connection produced is maintained in particularly reliable and permanently stable fashion.

Provision can be made that the tags are implemented as bending tags. This means that they are produced by bending from the base plate and can thus be produced simply and quickly.

Provision can be made that the grounding claw is a punch-and-bend component. This means on the one hand that a sufficiently stable component can be produced. On the other hand in particular tags can be produced simply and precisely (above all with sufficiently sharp edges).

Provision can be made that the tags are oriented in the direction of the cover plate and in the assembled state at least press, in particular in gripping fashion, into the cover plate. A particularly positionally fixed final position of the grounding claw relative to the cover plate is thereby achieved.

Provision can be made that the threaded shaft and the tags are arranged on opposite sides of the base plate, in particular are implemented integrally therewith, and project in opposite directions from the base plate. This means that the grounding claw is arranged as close as possible to the cover plate so that it is positioned in particular onto the base plate with a very small distance to the cover plate, while on the other hand a larger guide boss is then available on the opposite side, with the result that a more secure and mechanically stable connection, for example a screwed connection by means of a screw, is also achieved in the guide boss.

Provision can be made that the cover plate and the metal component, in particular the metal plate or the metal sheet, are arranged overlapping only in certain regions in at least one spatial direction if a connection to the grounding claw is implemented in the overlap region. This also means that a certain prepositioning is already achieved between the cover plate and the metal component and a certain mutual support is enabled. Since the components are then also connected to one another in said overlap region, in particular are screwed together, the number of connection elements and thus also connection points is minimized.

In particular, the household refrigeration appliance can be designed with a first receiving space for receiving food, which is implemented in the housing and is delimited by walls of an internal container. Said first receiving space can preferably be closed at the front by means of two separate doors which can be moved independently of one another and which are arranged in pivotable fashion about vertical pivot axes in particular on the housing. In particular, the household refrigeration appliance has a second receiving space separate from the first which is likewise designed for receiving food and which in particular is implemented beneath the first receiving space in the housing when viewed in the vertical direction. The second receiving space is likewise delimited by walls of an internal container and can be closed at the front by means of a further door separate from the other doors. The first receiving space can for example be a refrigerating compartment, whereas the second receiving space is preferably a freezer compartment.

Not only, but especially in the case of these appliances, electronics modules are also present which may for example comprise power electronics, control electronics and inverter electronics units. Especially in the case of these appliances provision is made that the openings implemented in a rear wall of the housing, which rear wall is constructed from metal, through which openings the electronics modules are accessible and are arranged adjacent to said openings in the rear wall in the interior of the housing, are covered toward the outside, in particular by the metallic cover plate, which for example can be a sheet metal lid.

The indications "top," "bottom," "front," "rear," "horizontal," "vertical," "depth direction," "width direction," "height direction" indicate the positions and orientations existing in the case of normal use and normal arrangement of the appliance and in the case of an observer standing in front of the appliance and looking in the direction of the appliance.

Further features of the invention will emerge from the claims, the figures and the description of the figures. The features and combinations of features stated above in the description as well as the features and combinations of features stated below in the description of the figures and/or shown by themselves in the figures can be used not only in the combination specified in each case but also in other combinations or in isolation without departing from the scope of the invention. Embodiments of the invention which are not explicitly shown and explained in the figures but emerge from and can be produced by separated combinations of features from the described embodiments are thus also to be regarded as included and disclosed. Embodiments and combinations of features which thus do not have all the features of an originally formulated independent claim are also to be regarded as disclosed.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

The same elements or elements having the same function are identified by the same reference characters in the figures.

DETAILED DESCRIPTION OF THE INVENTION

Figure 1:
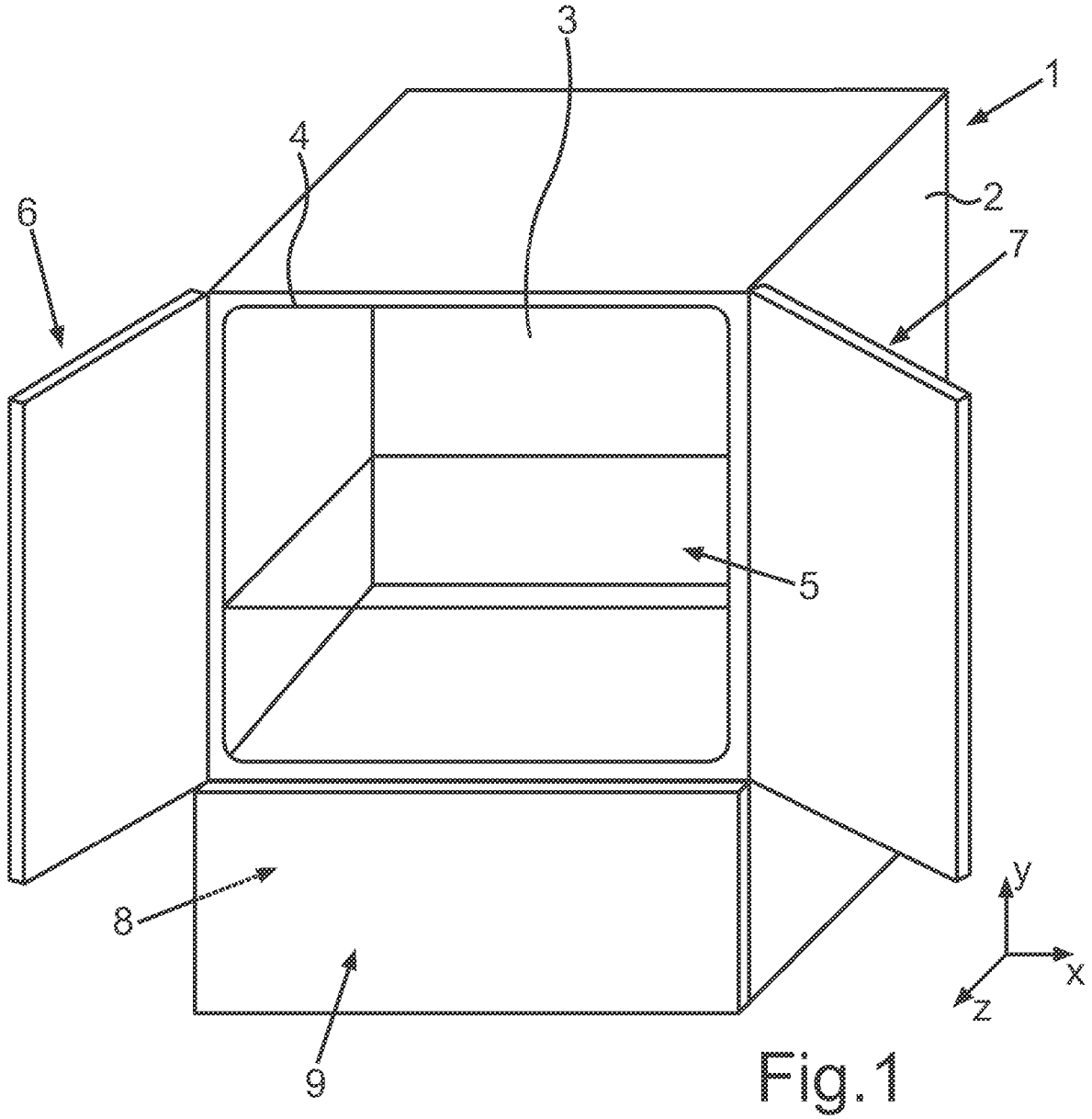
FIG. 1 shows a perspective illustration of an exemplary embodiment of a household refrigeration appliance according to the invention.

Referring now to the figures of the drawing in detail and first, particularly, to FIG. 1 thereof, there is shown a schematic illustration of a household refrigeration appliance 1 which is designed for the storage and conservation of foodstuffs. The household refrigeration appliance 1 of the exemplary embodiment is a refrigerator/freezer combination. It comprises a housing 2 in which a first receiving space 3 is implemented, which in the exemplary embodiment is a refrigerating compartment. The first receiving space 3 is delimited by walls of an internal container 4. On the front side, the internal container 4 and thus also the first receiving space 3 have a loading opening 5 which can be closed by means of two separate doors 6 and 7. The loading opening 5 is a continuous uninterrupted opening and the first receiving space 3 is also a continuous and uninterrupted space. The two doors 6 and 7 are articulated on the housing 2 in each case by way of pivot axes which are oriented vertically and are thus oriented in the height direction (y direction).

In the exemplary embodiment, the household refrigeration appliance 1 furthermore has a second receiving space 8 that is separate from the first receiving space 3; in the exemplary embodiment, the second receiving space 8 is which here is a freezer compartment. The second receiving space 8 is here in particular arranged beneath the first receiving space 3 when viewed in the vertical direction and thus in the height direction. In the height direction the two receiving spaces 3 and 8 are arranged in non overlapping fashion. The second receiving space 8 can be closed at the front by means of a separate third door 9, where said door 9 is implemented in particular as a front wall of a drawer which is slidable in the depth direction (z direction) and can be slid into and out of the second receiving space 8. The doors 6, 7 and 9 are arranged in non overlapping fashion with respect to one another and positioned next to one another on the front side. In particular they constitute closure parts or visible parts on the front of the household refrigeration appliance 1.

Figure 2:
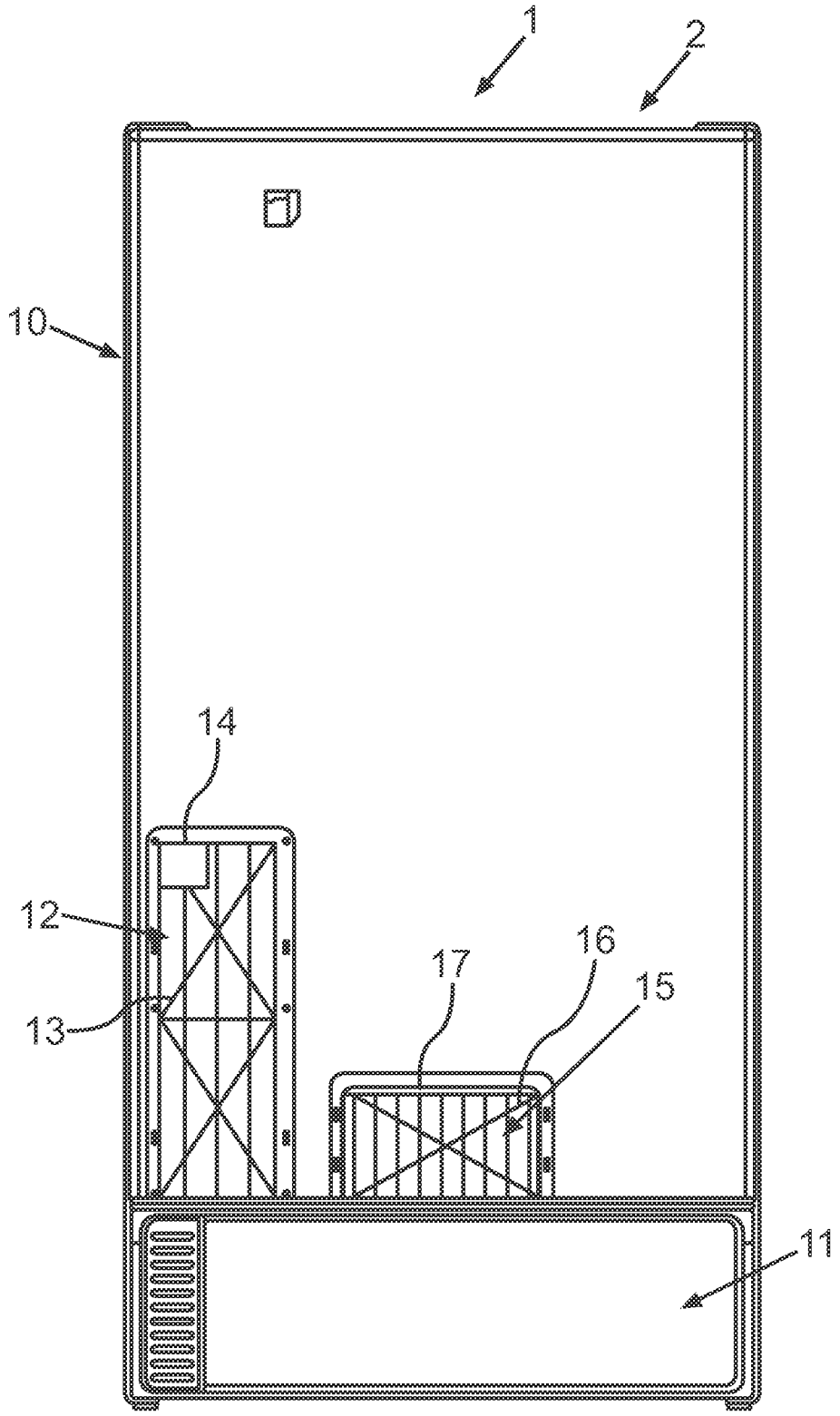
FIG. 2 shows a rear view of the household refrigeration appliance of FIG. 1 with the cover plates that are provided for covering electronics modules of the household refrigeration appliance removed.

FIG. 2 shows a rear view of the household refrigeration appliance 1, looking toward a rear wall of the housing 2. In this regard a machine compartment 11 can also be seen in the lower rear region, in which are arranged components of the refrigeration circuit of the household refrigeration appliance 1. The household refrigeration appliance 1 comprises a metal component in the form of a metal sheet 10. The metal sheet 10 essentially completely forms the rear wall of the household refrigeration appliance 1 and thus in particular constitutes an external paneling part which is thus in particular also an external visible part of the household refrigeration appliance 1. Arranged in the housing 2 is a first electronics module 12 which is arranged adjacent the metal sheet 10 implemented as a rear wall. FIG. 2 here shows a housing 13 of said electronics module 12. The housing 13 is constructed from plastic. An opening 14 through which the electronics module 12 is externally accessible is implemented in the metal sheet 10.

In the exemplary embodiment provision is made that a further second separate electronics module 15 is installed in the interior of the housing 2, which electronics module 15 likewise has a housing 16 and which is externally accessible by way of a further opening 17 in the metal sheet 10 and is thus accessible from the rear side of the household refrigeration appliance 1. In particular, an inverter electronics unit is contained in said electronics module 15. A power electronics unit and/or a control electronics unit can be installed in the first-mentioned electronics module 12.

Figure 3:
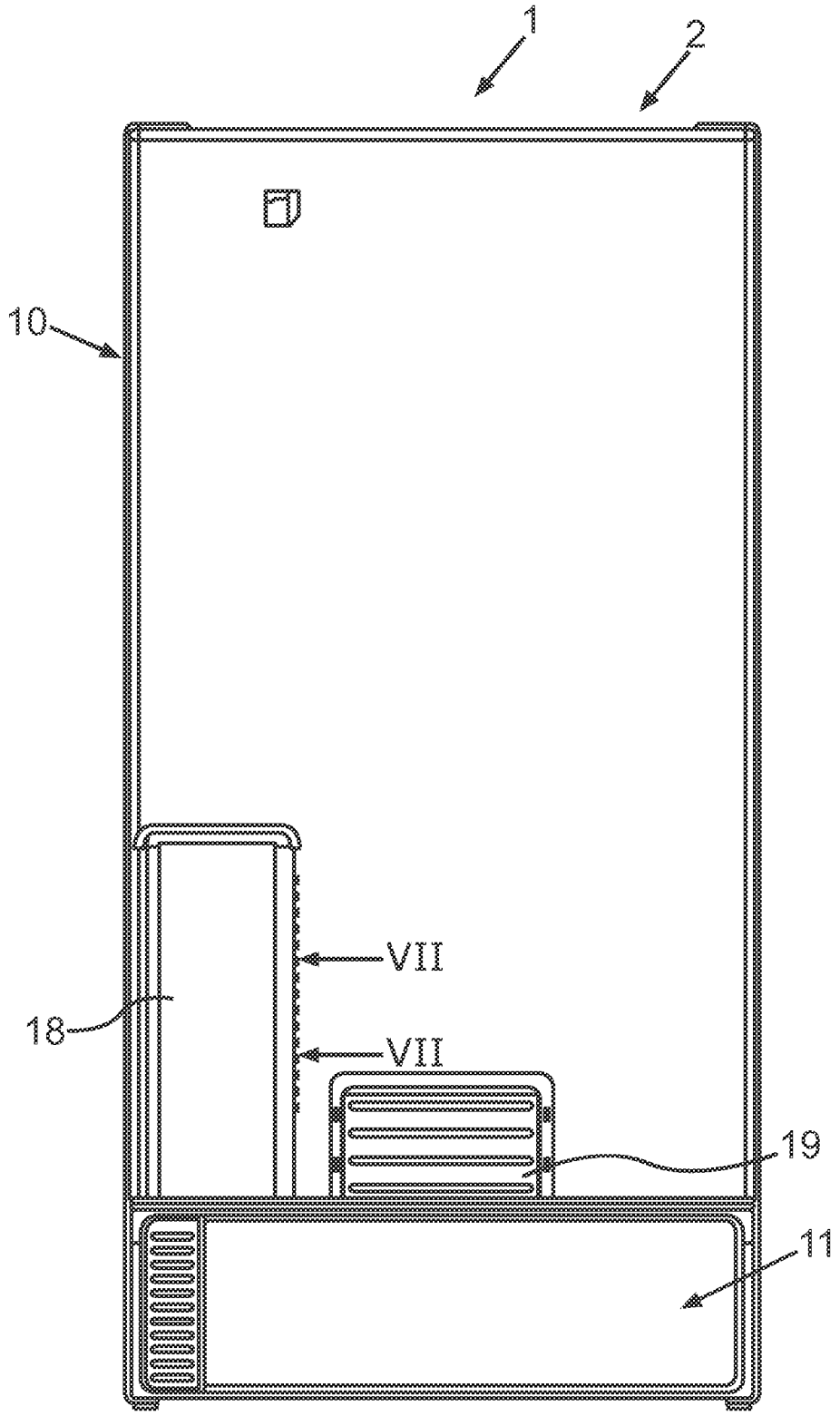
FIG. 3 shows the illustration according to FIG. 2 with the cover plates fitted thereon.

With reference to FIG. 3, in the fully assembled final state the opening 14 is covered by a cover plate 18 which is separate from the metal sheet 10 and is likewise constructed from metal.

Furthermore, a further separate cover plate 19 is installed which covers the opening 17 toward the rear and thus toward the exterior of the housing.

The metal sheet 10 is arranged in overlapping fashion with the cover plate 18 in the height direction (y direction) only in certain regions, in which case to this end the cover plate 18 dips under or behind the metal sheet 10. The corresponding provision is made with regard to the cover plate 19 and the metal sheet 10.

Figure 4:
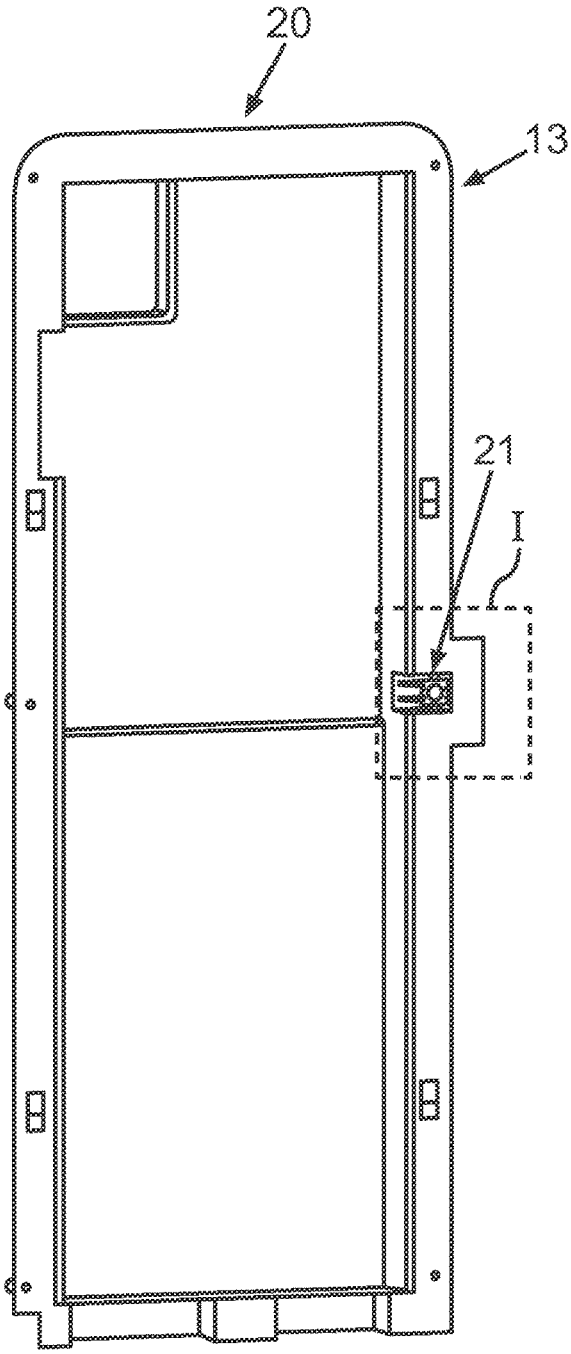
FIG. 4 shows a perspective illustration of a subarea of a housing of an electronics module.
Figure 5:
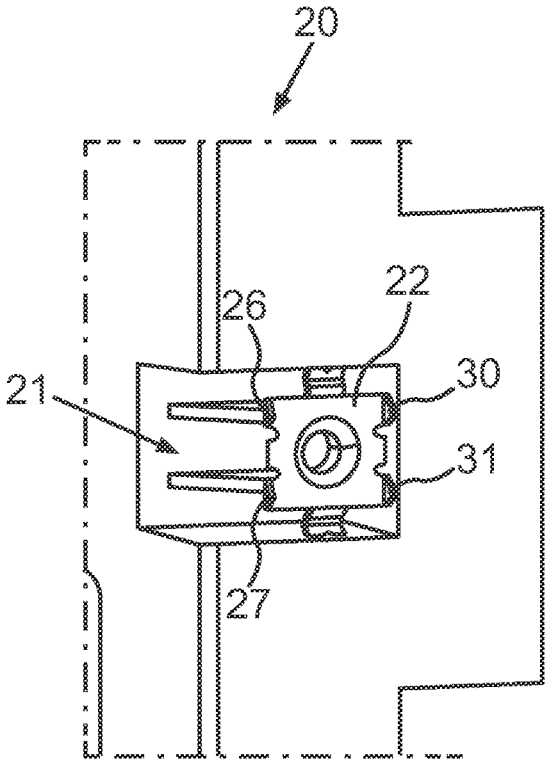
FIG. 5 shows an enlarged illustration of a partial section of FIG. 4.

FIG. 4 shows an enlarged illustration of a subcomponent 20 of the housing 13. Said subcomponent 20 of the housing 13, which faces the opening 14, has an integrated and thus integrally implemented receiving pocket 21 into which is inserted a grounding claw 22 (FIG. 5). The grounding claw 22—also referred to as a grounding clamp—is implemented separately from the receiving pocket 21 and is formed, in particular, integrally as a one piece element. FIG. 4 shows the side of the subcomponent 20 which faces the opening 14, which means that the receiving pocket 21 is open toward the opening 14. This can also be seen in the enlarged illustration of the partial view I from FIG. 4 in FIG. 5.

The grounding claw 22 is part of a ground connection by means of which the cover plate 18 is connected at ground potential. In this regard the metal sheet 10 is in particular grounded and said cover plate 18 is also grounded through the connection of the cover plate 18 to the metal sheet 10.

Figure 6:
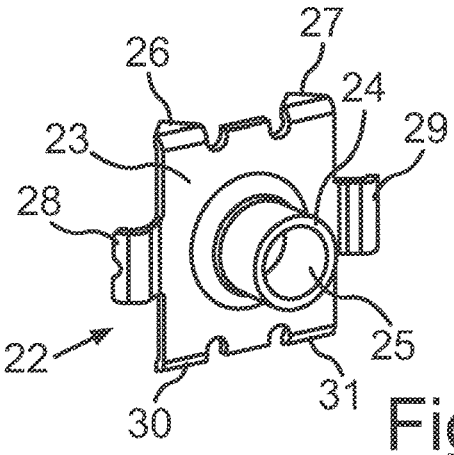
FIG. 6 shows a perspective illustration of an exemplary embodiment of a grounding claw.

The grounding claw 22 comprises, as is shown in the perspective illustration in FIG. 6, a base plate 23 which is implemented in polygonal fashion, in particular is square in shape. A screw boss or a threaded shaft 24, on the inside of which is implemented a (metric) thread 25, is implemented integrally on the base plate 23. At least one brace tab 26, 27, 28, 29, 30 and 31 is preferably implemented on each of the side lengths forming the angular shape of the base plate 23. The tabs 26 to 31 are implemented integrally on the base plate 28 and in particular are implemented as bending tabs. They are, as can be seen in FIG. 6, implemented on the opposite side of the base plate 23 to the threaded shaft 24. The tabs 26 to 31 therefore project from the base plate 23 in a direction which is opposite to the direction in which the threaded shaft 24 projects from the base plate 23.

Figure 7:
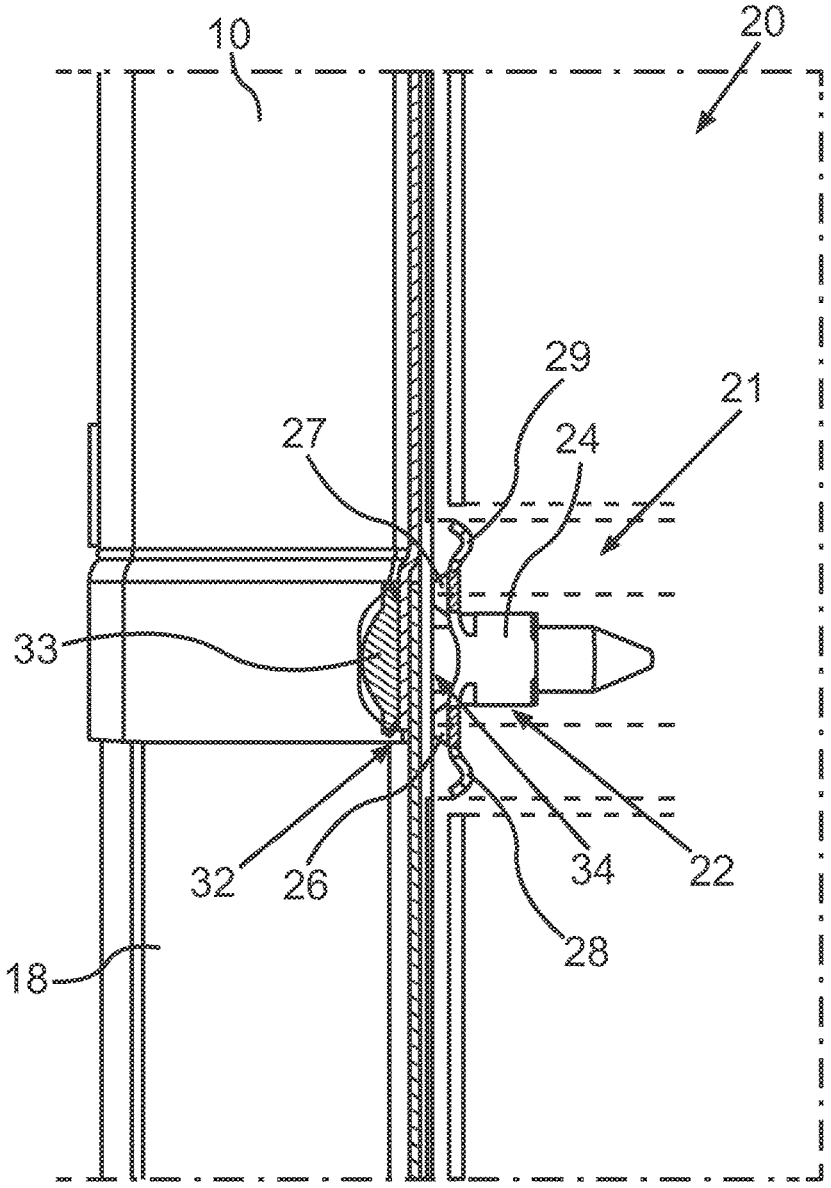
FIG. 7 shows a sectional view of the household refrigeration appliance in the region of the grounding claw.

FIG. 7 shows a sectional view along the section line VII-VII in FIG. 3 of a partial section of the household refrigeration appliance 1 in the region of the grounding claw 22. The already assembled final state is illustrated here. The ground connection 32 is likewise implemented here. In the exemplary embodiment, a screw 33 is screwed in as a connection element, in which case the position of the screw 33, which here can be a screw having a metric thread and a serrated flange, is in an overlap region 34 in which the metal sheet 10 and the cover plate 18 are arranged in overlapping fashion. As can be seen, the screw 33 is inserted from the outside through through-holes in the cover plate 18 and the metal sheet 10 and screwed into the thread 25 of the threaded shaft 24. The tabs 26 to 31 are pressed against the cover plate 18 and/or the metal sheet 10 or gripped therein. This means that they are pressed with their gripping tips into the aforementioned components at least in certain regions.

The metallic grounding claw 22 is thereby in both metallic and thus also electrical contact with the cover plate 18 and/or the metal sheet 10. The ground connection is then also implemented by way of the screw 33.

Figure 8:
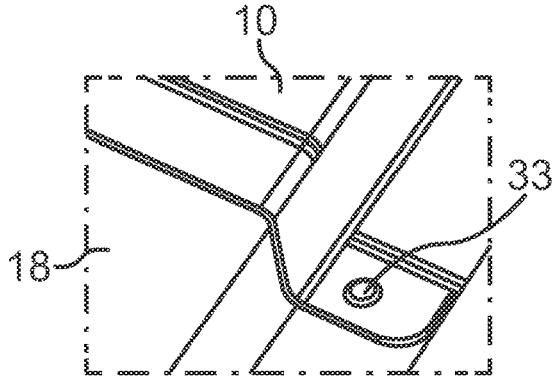
FIG. 8 shows a perspective partial illustration of the household refrigeration appliance in the region of the grounding claw according to FIG. 7.

FIG. 8 shows a perspective partial illustration of the household refrigeration appliance 1 in the region of the connection point.

The following is a summary list of reference numerals and the corresponding structure used in the above description of the invention:

1 Household refrigeration appliance
2 Housing
3 First receiving space
4 Internal container
6 Door
7 Door
8 Second receiving space
9 Door
10 Metal sheet
11 Machine compartment
12 Electronics module
13 Housing
14 Opening
15 Electronics module
16 Housing
17 Opening
18 Cover plate
19 Cover plate
20 Subcomponent
21 Receiving pocket
22 Grounding claw (ground tag)
23 Base plate
24 Threaded shaft
25 Thread
26-31 Tab
32 Ground connection
33 Screw
43 Overlap region

The invention claimed is:

1. An apparatus, comprising:

a household refrigeration appliance;

said household refrigeration appliance including a housing;

said household refrigeration appliance including an electronics module arranged in said housing;

said household refrigeration appliance including a metallic cover plate covering said electronics module at least in sections thereof;

said household refrigeration appliance including a metal component;

said household refrigeration appliance including a metallic grounding claw separate from said cover plate and from said metal component;

said metallic grounding claw and at least one connection element connecting said cover plate and said metal component to one another and said metallic grounding claw forming an electrical ground connection connecting said cover plate to electrical ground via said metal component;

said metallic grounding claw including a base plate and a plurality of tabs integrally formed on said base plate and projecting from a plane of said base plate;

said plurality of tabs pressing against said cover plate and said metal component at positions located at only one side of the plane of said base plate and; and said cover plate and said metal component overlapping in at least one overlap region, and said cover plate and said metal component not overlapping in at least one other region;

wherein said grounding claw is disposed on a housing of said electronics module.

2. An apparatus, comprising:

a household refrigeration appliance;

said household refrigeration appliance including a housing;

said household refrigeration appliance including an electronics module arranged in said housing;

said household refrigeration appliance including a metallic cover plate covering said electronics module at least in sections thereof;

said household refrigeration appliance including a metal component;

said household refrigeration appliance including a metallic grounding claw separate from said cover plate and from said metal component;

said metallic grounding claw and at least one connection element connecting said cover plate and said metal component to one another and said metallic grounding claw forming an electrical ground connection connecting said cover plate to electrical ground via said metal component;

said metallic grounding claw including a base plate and a plurality of tabs integrally formed on said base plate and projecting from a plane of said base plate;

said plurality of tabs pressing against said cover plate and said metal component at positions located at only one side of the plane of said base plate and; and said cover plate and said metal component overlapping in at least one overlap region, and said cover plate and said metal component not overlapping in at least one other region.

3. The apparatus according to claim 2, wherein said grounding claw has a guide boss for guiding said connection element at least in sections.

4. The apparatus according to claim 2, wherein at least one of said tabs is formed on an edge section of said base plate.

5. The apparatus according to claim 2, wherein said tabs are bending tabs.

6. The apparatus according to claim 2, wherein said tabs are oriented in a direction of said cover plate and, in an assembled state, press into said cover plate and/or into said metal component.

7. The apparatus according to claim 2, wherein said metal component is a metal sheet and said tabs are oriented in a direction of said cover plate and, in an assembled state, press into said cover plate and into said metal sheet.

8. The apparatus according to claim 2, wherein said grounding claw has a guide boss for guiding said connection element, and wherein said guide boss and said tabs are arranged on mutually opposite sides of said base plate and project in opposite directions from said base plate.

9. The apparatus according to claim 2, wherein said cover plate and said metal component overlap one another in certain regions in at least one spatial direction, and a connection to said grounding claw is formed in an overlap region.

10. The apparatus according to claim 2, wherein said metal component is a metal sheet overlapping with said cover plate in an overlap region and a connection to said grounding claw is formed in said overlap region.

11. The apparatus according to claim 2, wherein said grounding claw is disposed on a housing of said electronics module.

12. The apparatus according to claim 11, wherein said grounding claw is arranged in a receiving pocket in said housing of said electronics module.

13. The apparatus according to claim 2, wherein said base plate has a polygonal shape and at least one of said tabs is formed on each side length of said base plate.

14. The apparatus according to claim 13, wherein said base plate is substantially rectangular and each side of said base plate carries at least one of said tabs.

15. The apparatus according to claim 2, wherein said connection element comprises a screw and said grounding claw is screwed to said cover plate and said metal component by way of said screw.

16. The apparatus according to claim 15, wherein said metal component is a metal sheet.

17. The apparatus according to claim 15, wherein said screw has a serrated flange.

18. The apparatus according to claim 2, wherein said metal component is a metal sheet that forms a rear wall of the housing of the household refrigeration appliance.

19. The apparatus according to claim 18, wherein said metal sheet forms the rear wall of the housing of the household refrigeration appliance in sections thereof.

20. The apparatus according to claim 18, wherein said metal sheet forms the rear wall of the housing of the household refrigeration appliance substantially completely.

* * * * *